US008602220B1

(12) United States Patent
Porter

(10) Patent No.: US 8,602,220 B1
(45) Date of Patent: Dec. 10, 2013

(54) MAGNETIC BROOM

(71) Applicant: Earnest A. Porter, Fort Worth, TX (US)

(72) Inventor: Earnest A. Porter, Fort Worth, TX (US)

( * ) Notice: Subject to any disclaimer, the term of this patent is extended or adjusted under 35 U.S.C. 154(b) by 0 days.

(21) Appl. No.: 13/649,692

(22) Filed: Oct. 11, 2012

(51) Int. Cl.
*B07B 1/49* (2006.01)

(52) U.S. Cl.
USPC ..... 209/417; 209/215; 209/418

(58) Field of Classification Search
None
See application file for complete search history.

(56) References Cited

U.S. PATENT DOCUMENTS 1,468,431 A * 9/1923 Wodonos ..... 401/150
3,377,641 A * 4/1968 McGregor ..... 15/105
5,429,402 A * 7/1995 Kennedy ..... 294/65.5
2002/0166186 A1* 11/2002 Fernandez ..... 15/111
2003/0172482 A1* 9/2003 Tini ..... 15/167.1
2006/0277704 A1* 12/2006 Pineschi ..... 15/105
2010/0236571 A1* 9/2010 Haziza ..... 132/210
2012/0279520 A1* 11/2012 Sarris et al. ..... 134/6
2013/0031736 A1* 2/2013 Martin ..... 15/105

* cited by examiner

*Primary Examiner* — Terrell Matthews
(74) *Attorney, Agent, or Firm* — Kenneth L Tolar

(57) ABSTRACT

A magnetic broom includes a broom head having an upper surface, a lower surface and one or more peripheral edges. Extending from the upper surface is an elongated, removable handle. On the lower surface is a longitudinal cavity having a block received therein that carries a magnet on a bottom side. A knob on the upper surface of the head rotates a drive screw that is received within an internally-threaded bore formed through the block. Accordingly, rotation of the knob in either of two directions raises or lowers the block to position the magnet nearer or closer to an underlying surface. Surrounding the cavity and block are a plurality of bristles for compiling other non-ferromagnetic debris that is not otherwise removed by the magnet.

7 Claims, 1 Drawing Sheet

MAGNETIC BROOM

CROSS REFERENCE TO RELATED APPLICATIONS

This application is entitled to the benefit of provisional application No. 61/548,332 filed on Oct. 18, 2011, the specification of which is hereby incorporated by reference.

BACKGROUND OF THE INVENTION

The present invention relates to a magnetic broom for conveniently removing ferromagnetic debris.

DESCRIPTION OF THE PRIOR ART

Machine shops, garages and similar work areas often accumulate significant amounts of metal shavings and similar metallic particles. If the particles are not immediately removed, they can penetrate and damage footwear. In addition, the particles are often transported to other areas where they significantly damage carpet and other floor covering. Sweeping metallic particles with a conventional broom is burdensome and ineffective since the particles easily adhere to underlying surfaces.

Accordingly, there is currently a need for a device that easily removes metallic particles from a floor. The present invention addresses this need by providing a magnetic broom that easily lifts metallic debris from an underlying surface.

SUMMARY OF THE INVENTION

The present invention relates to a magnetic broom comprising a broom head having an upper surface, a lower surface and one or more peripheral edges. Extending from the upper surface is an elongated, removable handle. On the lower surface is a longitudinal cavity having a block received therein that carries a magnet on a bottom side. A knob on the upper surface of the head rotates a drive screw that is received within an internally-threaded bore formed through the block. Accordingly, rotation of the knob in either of two directions raises or lowers the block to position the magnet nearer or closer to an underlying surface. Surrounding the cavity and block are a plurality of bristles for compiling other nonferrous debris that is not otherwise removed by the magnet.

It is therefore an object of the present invention to provide a magnetic broom that easily removes ferrous debris from work surfaces.

It is another object of the present invention to provide a magnetic broom that allows a user to also compile non-ferromagnetic debris, if necessary.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
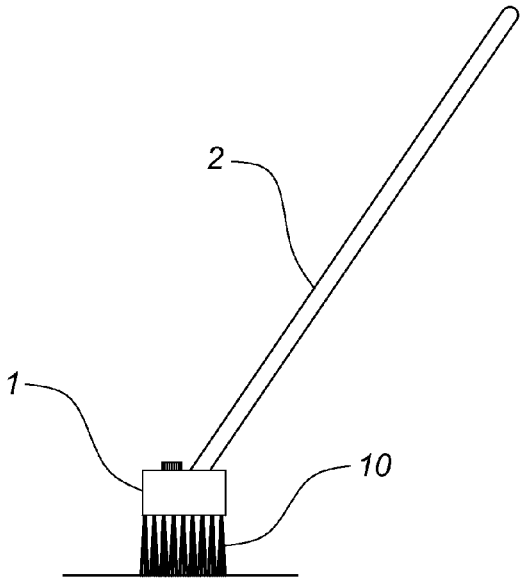
FIG. 1 is a side, plan view of the broom according to the present invention.
Figure 2:
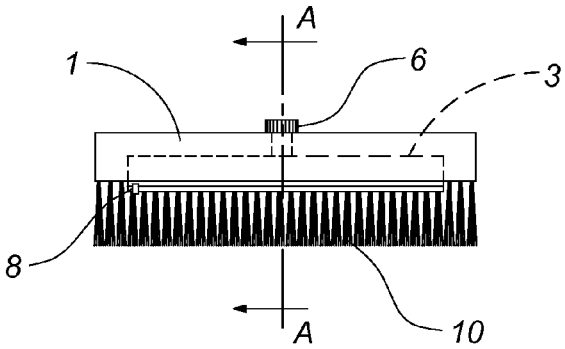
FIG. 2 is an isolated, front view of the head.
Figure 3:
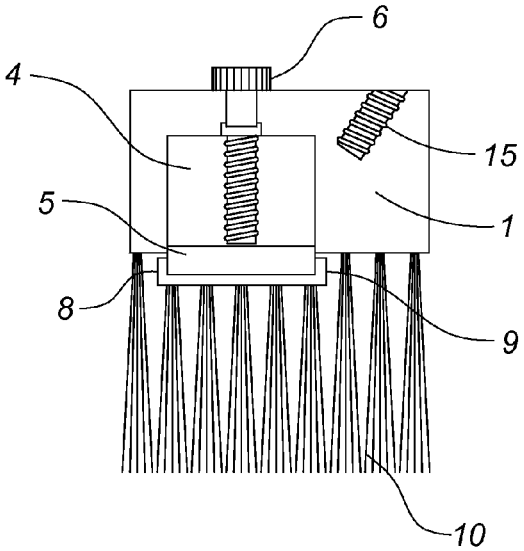
FIG. 3 is a sectional view of the head along A-A in FIG. 2 with the magnet in a raised position.
Figure 4:
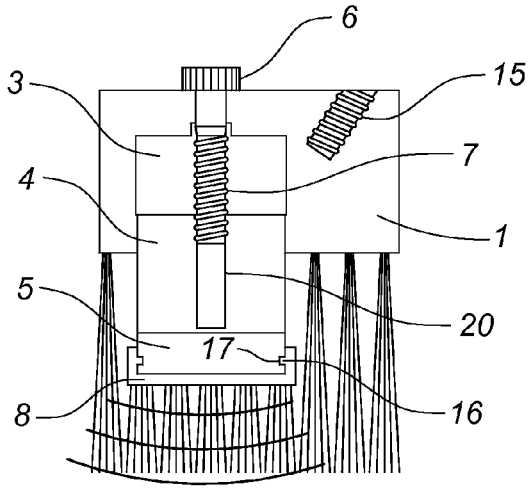
FIG. 4 is a sectional view of the head along A-A in FIG. 2 with the magnet in a lowered position.

The present invention relates to a magnetic broom comprising a broom head 1 having an upper surface, a lower surface and one or more peripheral edges. Extending from the upper surface is an elongated, removable handle 2. Preferably, the handle includes a threaded lower end that fits within an internally-threaded bore 15 formed through the head 1. On the lower surface is a longitudinal cavity 3 having a block 4 received therein that carries a magnet 5 on a bottom surface. A knob 6 on the upper surface of the head rotates a drive screw 7 that is received within an internally-threaded bore 20 formed through the block. Accordingly, rotation of the knob in either of two directions raises or lowers the block to position the magnet nearer or closer to an underlying surface.

Slidably mounted on the magnet is a scraper 8 formed of a U-shaped wiping blade having two opposing, parallel arms 9, each having a projection 16 thereon that is received within a designated groove 17 on one of the magnet side edges. The scraper is slid from one end of the magnet to the other to remove adhering ferrous debris.

Depending from the lower surface of the head 1 are a plurality of semi-rigid bristles 10 for sweeping other non-ferromagnetic debris that is not otherwise removed by the magnet. The bristles are preferably arranged in a U-shaped pattern around the periphery of the head to partially expose a front portion of the block and scraper. Accordingly, as the broom is pushed over a surface, the front opening allows any ferromagnetic debris to be immediately removed by the magnet prior to engaging the bristles. As the broom head travels further, the bristles push any remaining non-ferromagnetic material forward.

The above-described device is not limited to the exact details of construction and enumeration of parts provided herein. The bristles are preferably constructed with a synthetic thread or a similar equivalent. However, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A magnetic broom comprising:

a broom head having an upper surface, a lower surface and a periphery;

an elongated handle extending from the upper surface of said broom head;

a plurality of bristles depending from the lower surface of said broom head;

a cavity formed in the lower surface of said head;

a block received within said cavity, said block having an upper surface and a lower surface;

a magnet mounted on the lower surface of said block;

a drive screw received within an internally-threaded bore formed through said block whereby rotation of the drive screw in either of two directions vertically translates said block to adjust a distance of said magnet relative to an underlying surface.

2. The broom according to claim 1 further comprising a scraper slidably mounted on said magnet for removing adhered debris therefrom.

3. The broom according to claim 2 wherein said scraper is formed of a U-shaped wiping blade having two opposing, parallel arms, each of said arms having a projection thereon that is received within a groove on said magnet.

4. The broom according to claim 1 wherein said bristles are arranged to surround said magnet and to expose a portion thereof.

5. The broom according to claim 4 wherein said bristles are arranged in a U-shaped pattern around the periphery of said head to partially expose a front portion of the magnet to allow ferromagnetic debris to be immediately removed by the magnet prior to engaging said bristles.

6. A magnetic broom comprising:

a broom head having an upper surface, a lower surface and a periphery;

an elongated handle extending from the upper surface of said broom head;

a plurality of bristles depending from the lower surface of said broom head;

a magnet on the lower surface of said broom head for collecting ferromagnetic debris from an underlying surface;

a scraper slidably mounted on said magnet for removing adhered debris therefrom, said scraper formed of a U-shaped wiping blade having two opposing, parallel arms, each of said arms having a projection thereon that is received within a groove on said magnet.

7. The broom according to claim 6 wherein said magnet is height-adjustable.

* * * * *